United States Patent [19]

Scherer

[11] Patent Number: 5,021,008

[45] Date of Patent: Jun. 4, 1991

[54] TANGLE FREE MANUALLY ENGAGEABLE DEVICE

[76] Inventor: Peter J. Scherer, R.R. 1 Box 53, Machias, N.Y. 14101

[21] Appl. No.: 540,162

[22] Filed: Jun. 19, 1990

[51] Int. Cl.[5] ..... H01R 13/00

[52] U.S. Cl. ..... 439/504; 439/829

[58] Field of Search ..... 439/503, 504, 506, 759, 439/822, 829, 835

[56] References Cited

U.S. PATENT DOCUMENTS

| | | | |
|---|---|---|---|
| 3,641,473 | 2/1972 | Attaway | 439/506 |
| 4,923,415 | 5/1990 | Lee | 439/506 |
| 4,934,957 | 6/1990 | Bellusci | 439/504 |

*Primary Examiner*—Joseph H. McGlynn

*Attorney, Agent, or Firm*—Hodgson, Russ, Andrews, Woods & Goodyear

[57] ABSTRACT

A manually engageable device (30) consisting of an elongated first element (32), a second element (34) and a grip lever (88) the second element being pivoted to one side of the first element. The first element has an elongated grip portion extending between a first end and the pivot receiving portion, whereas the second pivotal element has a relatively short portion between the first end and the pivot receiving portion. The grip lever has first and second ends and a grip portion between the ends, the second end being pivotally secured to the first end of the second element by a pivot (94) and the other end of the grip lever being interconnected with the first end of the first element by means of a pin and slot connection. A spring (80) normally biases the two grip portions away from each other.

6 Claims, 2 Drawing Sheets

Fig. 1.
PRIOR ART
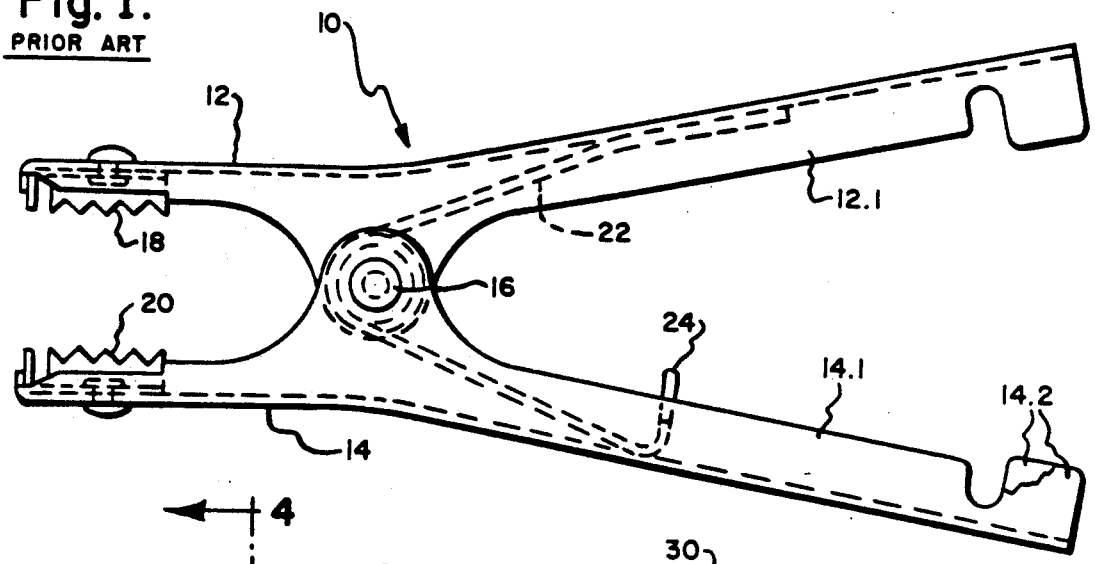
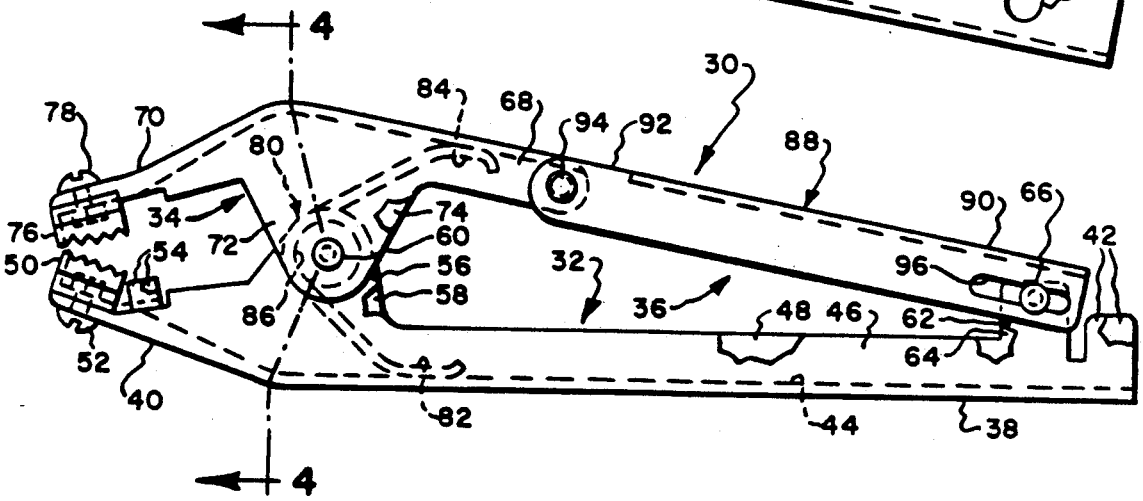
Fig. 2.
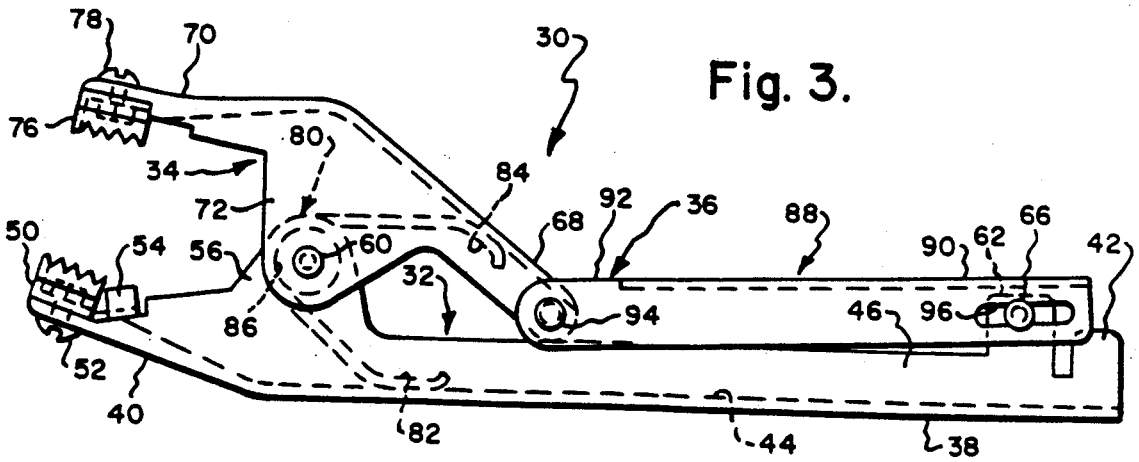
Fig. 3.

TANGLE FREE MANUALLY ENGAGEABLE DEVICE

TECHNICAL FIELD

The present invention relates generally to tangle free manually engageable devices, and more particularly to tangle free manually engageable devices mounted at the ends of cables or the like, such as clamps for a battery jumper cable assembly, wherein each tangle free manually engageable clamp is moved from a normally closed condition to an open condition by manually engaging a pair of handles or grips and moving at least one of them towards the other by closing the hand.

BACKGROUND OF THE INVENTION

Manually engageable devices which are mounted on the ends of cables and the like, for example clamps for battery booster cables, often become tangled with the associated cable, other wires, etc. Thus, for example, a clamp mounted on the end of a battery cable can have an open handle portion snag the cable, causing entanglement. This is due to the construction of most battery cable clamps. These devices are constructed from a pair of levers provided with facing bosses, the bosses receiving a pivot pin. Each of the levers includes a jaw portion located to one side of the associated boss, and a handle or grip portion located to the other side of the associated boss. One of the jaws is connected to a heavy electrical cable, the cable being laid along the inside of the handles, while the handle or grip portion of the other lever is free. A spring, typically positioned about the pivot pin, forces the jaw portions of the pair of levers together while causing the handle portions to be spread apart. When it is desired to engage a terminal of a battery one manually engages the grip portions to force them together, causing the jaw portions to be moved against spring pressure from a closed position to an open position. Once the clamp is properly positioned, the grip portions are released, permitting the spring to pivot the jaws towards their closed position. After the use the cables are frequently thrown into the trunk of a car or a tool box. When they are to be used next, typically the handle portion which is not associated with a cable snags the cable at a remote location, other wires, and/or other objects, causing the cables to become entangled. Thus, the handles of the jumper cable clamps commonly define a V-shaped spacing therebetween, and the V-shaped spacing is believed to be at least partially responsible for the tangling because the spacing is permitted to accept portions of the cable.

OBJECTS AND SUMMARY OF THE INVENTION

It is an object of the present invention to provide a tangle free manually engageable device operable by the manipulation of pivotally connected levers which will overcome the disadvantages of the prior art.

More specifically, it is an object of the present invention to provide tangle free manually engageable devices which are mounted on cables or the like which will not become tangled with the associated cable, other wires, etc.

It is another object of the present invention to provide a device of the type set forth above which is relatively uncomplicated in construction and effective in operation.

A further object of the present invention is to provide a jumper cable assembly having a pair of jumper cables with jumper cable clamps at either end, the clamps being so designed that they do not become entangled with the associated pair of cables.

In summary, the above is accomplished by providing a manually engageable device consisting of an elongated first element, a second element pivoted to one side of the first element, and a grip lever. The first element has an elongated gripping portion extending between a first end and the pivot portion whereas the second pivotal element has a relatively short portion between the first end and the pivot receiving portion. The grip lever is disposed to one side of the first portion of the first element, the grip lever having first and second ends, the second end being pivotally secured to the first end of the second element by a pivot and the other end of the grip lever being interconnected with the first end of the first element by means of a pin and slot connection. A gripping portion is disposed between the two ends. A spring normally biases the two gripping portions away from each other.

The foregoing objects and other objects and advantages of the present invention will be more fully understood after a consideration of the following detailed description taken in conjunction with the accompanying drawings in which a preferred embodiment of the present invention is illustrated.

BRIEF DESCRIPTION OF THE DRAWINGS

FIG. 1 is a side elevation view of a prior art battery clamp.

FIG. 2 is a side elevation view of a tangle free manually engageable device constructed in accordance with the principles of the present invention, the manually engageable device illustrated being a battery clamp for a jumper clamp.

FIG. 3 is a view similar to FIG. 2 illustrating the clamp in an opened position.

DETAILED DESCRIPTION

Figure 4:
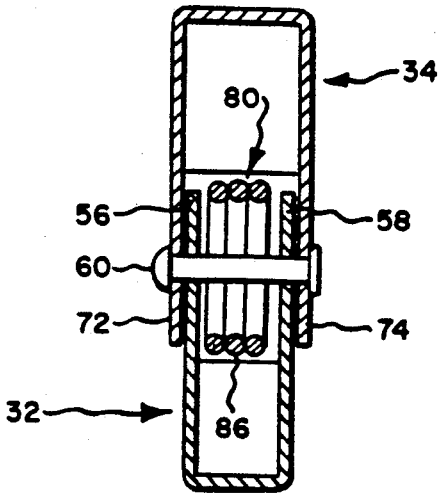
FIG. 4 is a cross-sectional view taken generally along the line 4—4 in FIG. 2.
Figure 5:
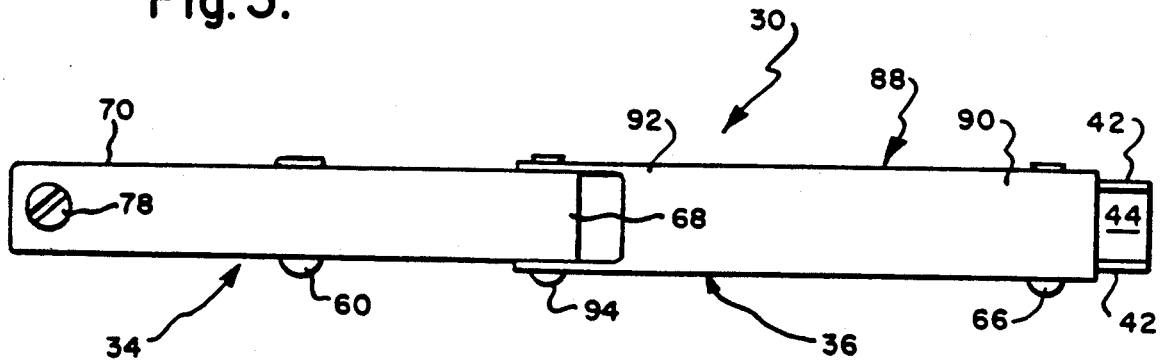
FIG. 5 is a plan view of the device shown in FIG. 2.

A prior art battery cable clamp is illustrated in FIG. 1, the clamp being indicated generally by reference numeral 10. Such prior art clamps typically consist of two levers 12 and 14 which are pivotally interconnected together by a pivot pin or rivet 16 in such a manner that as the handle portions of the levers 12.1 and 14.1 are biased together the battery terminal engaging jaws 18 and 20 carried by the levers 12 and 14, respectively will move apart. Normally the battery terminal engaging jaws 18 and 20 are biased together by a spring 22 which is disposed within the handles and is coiled about the pivot 16, one end of the wire which forms the spring 22 conventionally being provided with a hook portion 24 through which one end of a battery cable (not shown) may be fed, the battery cable being held in place within the handle, to this end the handle is typically formed of sheet metal formed into an U-shape the cable being laid between the sides of the U. Extension 14.2 are provided which can be bent about the cable to secure the cable within the handle. The leading end of the cable is in turn connected to the battery terminal engaging jaw 18 or 20 by a setscrew or the like (which setscrew is not shown in the drawing). The construction described above is conventional. It has been found that frequently battery jumper cables which include four battery jumper cable clamps, two at either end, frequently become entangled because the free end of the lever 12.1 can snag the cable at various locations, as well as other wires, etc.

In accordance with this invention an improved design has been developed, which tangle free manually engageable device is indicated generally at 30. While the device of the present invention has particularly utility with use in battery jumper cables, it may have other uses. Therefore, while a preferred embodiment will now be described in association with a battery jumper cable, it should be appreciated that other embodiments may be developed as will more fully brought out below. In any event, while only a single jumper cable clamp is illustrated in FIGS. 2 through 5, typically a battery cable set will have two jumper cables which are interconnected to each other, each cable having at its opposed ends a jumper cable clamp. Thus, four jumper cable clamps are in each set. Each jumper cable clamp will be secured to a jumper cable in a conventional manner in the same manner as is the prior art jumper cables. Therefore, for simplicity of illustration the jumper cable clamps of this invention have not been shown connected to jumper cables.

Each of the tangle free manually engageable jumper cable clamps 30 consists of three major components, these being an elongated first element indicated generally at 32, a pivotal second element, indicated generally at 34, the pivotal second element being disposed primarily to one side of the elongated first element, and a grip or gripping lever which is also located to one side of the elongated first element, the gripping lever being indicated generally at 36. The elongated first element has first and second ends 38, 40, the first end being adapted to be secured to a battery cable or the like. For this purpose the first end 38 is provided with bend-down tabs 42 which may be bent about an end portion of an electrical battery cable, the tabs 42 engaging an insulated portion as is conventional. The elongated first element will preferably be formed of U-shaped metal having a bight portion 44 and spaced apart sidewalls 46 and 48, the tabs 42 being an extension of the sidewalls. A battery terminal engaging jaw 50 of conventional design is mounted on the end 40 by means of a screw 52 or other fastener device such as a rivet. As is conventional in prior art clamp designs the end portion of the battery cable is laid between the sidewalls 46 and 48, a bared end of the cable being engaged by a setscrew (not illustrated) or spaced apart tabs 54 which are part of the battery terminal engaging jaw, which tabs 54 are bent about the ends of the cable. The battery cable engaging jaw 50 and tabs 54 are all formed from a single piece of copper or copper alloy metal. As can be seen from FIG. 2 the elongated first element 32 is provided with an intermediate pivot receiving portion which is formed by upwardly extending bosses or ears 56, 58 formed on sidewalls 46, 48, respectively. The two bosses are provided with aligned apertures for the receipt of a pivot pin 62. A portion of the sidewalls 46 and 48 adjacent the first end 38 is also provided with a pair of upwardly extending bosses or ears 62, 64 which support a transversely extending pin 66. The pin is typically force-fit within aligned apertures within the ears 62 and 64 but it may be secured in any conventional manner. The portion of the first element between the first end 38 and the bosses 56, 58 is an elongated gripping portion.

The pivotal second element is to a large extent very similar to the pivotal first element and thus it to includes first and second spaced apart ends 68, 70. In addition, the second element 34 is provided with downwardly extending apertured bosses or ears 72, 74 which are also suitably apertured for the reception of pivot pin 60. The second end 70 also receives a battery terminal engaging jaw 76 which is held in place by screw 78 or other fastener. It should be noted at this point that the portion of the second element 32 between the pivot 60 and the first end 68 is relatively short when compared to the elongated gripping portion of the first element 32.

A spring, indicated generally at 80 in FIG. 4, is disposed between the first and second portions 32, 34, the spring being coiled wire design and including spaced apart arms 82, 84 (FIG. 2) and a coil 86 disposed about the pivot pin 60.

In accordance with this invention a grip lever indicated generally at 88 is provided, the grip lever also being of a generally U-shaped construction and having first and second spaced apart ends 90, 92. A second pivot pin 94 connects the second end 92 of the grip lever 88 to the first end of the pivoted second element 34. The grip lever 88 is U-shaped in cross-section, and the spaced apart sidewalls are provided with aligned slots 96 which receive ends of the pin 66. The grip lever has a gripping portion between its end 90, 92.

In operation it is only necessary to engage the elongated gripping portion of the first element 32 between the first end 38 and the pivot 60 while at the same time engaging the gripping portion of the lever 88 to move the part from the position shown in FIG. 2 to the position shown in FIG. 3, where the jaws will become open so that upon release of the force they can close to engage a battery post as is well known in the art.

Figure 6:
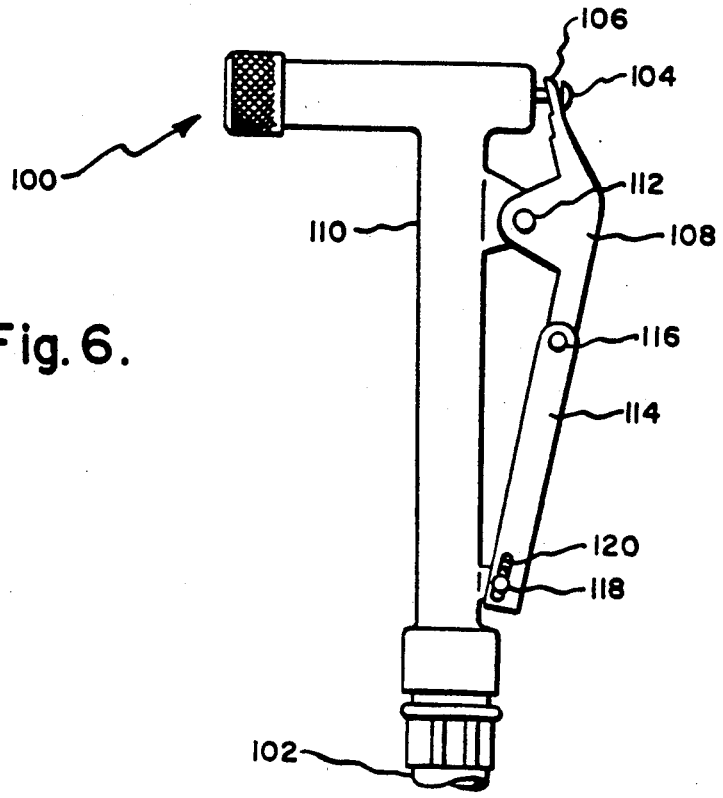
FIG. 6 is a side elevation view of another embodiment of the present invention, the principles of the present invention having been embodied in a spraying nozzle for a garden hose.

While the invention has been described so far in connection with a battery cable clamp, the present invention also has utility in other applications. In FIG. 6 it is shown in combination with a water nozzle indicated generally at 100, the water nozzle being of the type which may be screwed upon one end of a garden hose 102. The nozzle is of the type provided with an internal valve normally biased in a left-hand direction by an internal spring, the valve being moved to an open position by a headed pin 104. The headed pin may be engaged by a fork element 106, which fork element is carried at the second end of a pivoted second element 108, the first element being the elongated body 110 of the nozzle 100. The pivoted second element 108 is disposed to one side of the body 110 and is pivotally secured thereto by means of a pivot pin 112. The internal valve spring will normally bias the pin 104 to the left which causes the second element 108 to be biased in a counterclockwise direction about the pivot pin 112. The second element can be moved in the opposite direction by engaging a gripping element 114 at the same time the body 110 is engaged. The gripping element 114 is pivotally secured at one end to the first end of the pivoted second element by a further pivot pin 116, while the other end of the gripping element 114 is connected to the body 110 by a pin 118 and slot 120. It can therefore be appreciated from the above cursory description of the structure shown in FIG. 6 that the principles of this invention are not to be limited to the particular details shown in FIGS. 2 through 5 but that widely differing means may be employed in the practice of the broader aspects of this invention.

What is claimed is:

1. A tangle free manually engageable device adapted to be secured to a cable or the like comprising:

an elongated first element having first and second ends and a pivot receiving portion located between the ends, the first end being adapted to be secured to the cable or the like, the first element further having an elongated gripping portion between the pivot receiving portion and the first end;

a pivotal second element disposed to one side of the elongated first element and having first and second ends and a pivot receiving portion between the ends, the pivotal second element further having a relatively short portion between the first end and the pivot receiving portion considerably shorter than the elongated gripping portion of the first element;

a first pivot pin extending through the pivot receiving portions of the first and second elements for pivotally securing the second element to the first element in such a manner that as the first ends move apart the second ends move together;

spring means extending between the first and second elements for forcing the second ends of the first and second elements towards one another;

a gripping lever disposed to one side of the elongated first element and extending between the first end of the first element and the first end of the second element, the gripping lever having first and second spaced apart ends;

a second pivot pin connecting the first end of the gripping lever of the first end of one of the first and second elements; and slidable connection means for slidably connecting the second end of the gripping lever and the first end of the other of the first and second elements.

2. The tangle free manually engageable device as set forth in claim 1 wherein the second pivot pin connects the first end of the gripping lever to the first end of the elongated first element.

3. The tangle free manually engageable device as set forth in claim 2 wherein the slidable connection means is a pin and slot connector.

4. The tangle free manually engageable device as set forth in claim 3 wherein the gripping lever is provided with an elongated slot adjacent its second end, and the first end of the pivotal second element is provided with transversely extending pin received within the slot.

5. A tangle free manually engageable battery jumper cable clamp securable to a battery jumper cable comprising:

an elongated first element having first and second ends and a pivot receiving portion located between the ends, the first end being adapted to be secured to a battery jumper cable and the second end being provided with a battery terminal engaging jaw, there being an elongated gripping portion between the pivot receiving portion and the first end;

a pivotal second element having first and second ends and a pivot receiving portion between the ends, the second end being provided with a battery terminal engaging jaw, the portion of the pivotal second element between the first end and the pivot receiving portion being considerably shorter than the elongated gripping portion of the first element;

a first pivot pin extending through the pivot receiving portions of the first and second elements for pivotally securing the second element to the first element in such a manner that as the first ends move apart the battery terminal engaging jaws will move together;

spring means extending between the first and second elements for forcing the jaws on the second ends of the first and second elements towards one another;

a gripping lever extending between the first end of the first element and the first end of the second element, the gripping lever having first and second spaced apart ends;

a second pivot pin connecting the first end of the gripping lever to the first end of one of the first and second elements; and slidable connection means for slidably connecting the second end of the gripping lever the first end of the other of the first and second elements.

6. A tangle free manually engageable battery jumper cable assembly comprising:

a pair of jumper cables; and a pair of jumper cable clamps mounted on each battery cable, each of the battery jumper cable clamps comprising an elongated first element having first and second ends and a pivot receiving portion located between the ends, the first end being secured to a battery jumper cable and the second end being provided with a battery terminal engaging jaw, there being an elongated gripping portion between the pivot receiving portion and the first end;

a pivotal second element having first and second ends and a pivot receiving portion between the ends, the second end being provided with a battery terminal engaging jaw, the portion of the pivotal second element between the first end and the pivot receiving portion being considerably shorter than the elongated gripping portion of the first element;

a first pivot pin extending through the pivot receiving portions of the first and second elements for pivotally securing the second element to the first element in such a manner that as the first ends move apart the battery terminal engaging jaws will move together;

spring means extending between the first and second elements for forcing the jaws on the second ends of the first and second elements towards one another;

a gripping lever extending between the first end of the first element and the first end of the the second element, the gripping lever having first and second spaced apart ends;

a second pivot pin connecting the first end of the gripping lever to the first end of one of the first and second elements; and slidable connection means for slidably connecting the second end of the gripping lever the first end of the other of the first and second elements.

* * * * *